United States Patent [19]

Pasquale

[11] Patent Number: 4,777,751

[45] Date of Patent: Oct. 18, 1988

[54] PORTABLE ILLUMINATED SIGNAL PERSON STATION

[76] Inventor: Aquino R. Pasquale, 4025 S. Brickyard Rd., North East, Pa. 16428

[21] Appl. No.: 44,149

[22] Filed: Apr. 30, 1987

[51] Int. Cl.[4] ..... G09F 15/00; E04G 3/16

[52] U.S. Cl. ..... 40/612; 40/610; 182/17; 280/655; 340/908; 340/114 R

[58] Field of Search ..... 40/612, 610, 601, 606; 340/907, 908, 114 B, 114 R, 119; 404/9; 280/43.1, 655, 654, 652, 651; 182/17, 15, 16

[56] References Cited

U.S. PATENT DOCUMENTS

| | | | |
|---|---|---|---|
| 1,814,960 | 7/1931 | Parry | 182/16 |
| 2,472,407 | 6/1949 | David et al. | 280/654 X |
| 2,528,962 | 11/1950 | Lieutard | 40/612 X |
| 3,273,118 | 9/1966 | Hendershot | 340/119 X |
| 3,675,613 | 7/1972 | Sayles | 40/610 X |
| 3,677,573 | 7/1972 | Chin | 280/43.1 |

FOREIGN PATENT DOCUMENTS

| | | | |
|---|---|---|---|
| 1509040 | 12/1967 | France | 280/655 |
| 2302228 | 9/1976 | France | 280/652 |
| 2118908 | 11/1983 | United Kingdom | 40/612 |

*Primary Examiner*—Leonard E. Smith

*Attorney, Agent, or Firm*—Charles L. Lovercheck; Wayne L. Lovercheck

[57] ABSTRACT

A portable iluminated signal person station is disclosed having a first frame supported on legs and a second frame having legs pivoted to it. A person can stand on the platform and direct traffic. Signs, light and reflectors can be supported on the second frame to add visibility and a spot light can be supported on the second frame and directed onto the signal person on the platform to increase his visibility.

12 Claims, 3 Drawing Sheets

PORTABLE ILLUMINATED SIGNAL PERSON STATION

BACKGROUND OF THE INVENTION

Traffic control signal person at road construction sites, school crossings and accident scenes are barely visible to motorists, especially at night and during bad weather. At road construction sites, the entire road is sometimes blocked an a road crew may consist of a group of men who have little protection from the oncoming motorists who may not see the traffic control person and a serious accident may result.

GENERAL STATEMENT OF THE INVENTION

The portable illuminated signal person station disclosed herein is used to attach various arrangements of traffic control lights and signals creating a portable illuminated traffic control signal station. The station is intended to increase the visibility of a signal person to a motorist during roadwork, police emergency, school crossing guards, firefighters, utility screws and many other temporary traffic interruptions. The station can be manufactured of steel, aluminum, plastic, fiberglass or other suitable materials. The sizes, shapes and styles may vary to accommodate individual applications for example, a road construction signal person may prefer a handrail, sign holder, radio mount, etc., convenient to his trade and length of time he may spend with the signal station.

The station is portable and can be folded and placed in the trunk of an automotive vehicle and in case of an accident, it can be used by a police officer or the like by lighting a red flashing emergency light or spot light to shine on a traffic control officer, where it is only used a few minutes at a time.

REFERENCE TO PRIOR ART

Applicant knows of no prior art or publication showing an illuminated traffic control signal which incorporates a platform for an officer to stand on.

OBJECTS OF THE INVENTION

It is an object of the invention to provide an improved, highly visable traffic control station.

Another object of the invention is to provide a traffic control station that is simple in construction, economical to manufacture and simple and efficient to use and portable.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWINGS

Figure 1:
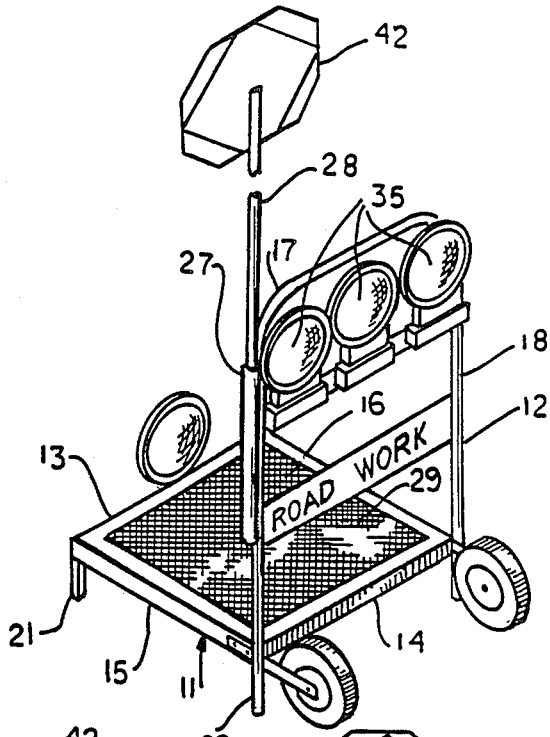
FIG. 1 is an isometric view of the portable illuminated traffic signal person station according to the invention with a sign and control lights.
Figure 2:
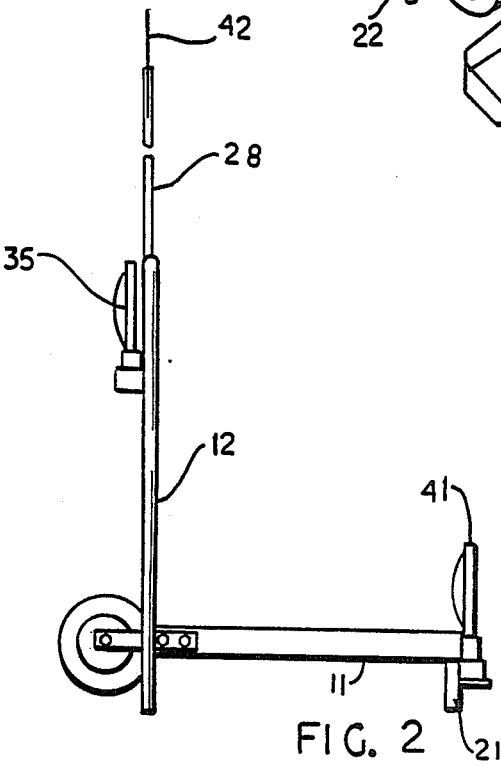
FIG. 2 is a side view of the station shown in FIG. 1.
Figure 3:
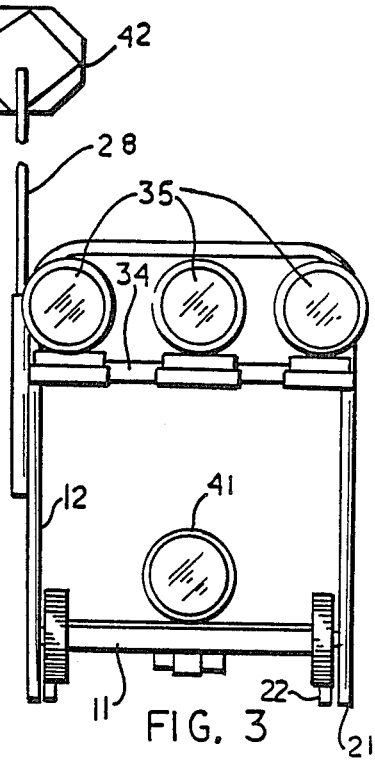
FIG. 3 is a rear view of the station shown in FIG. 1.
Figure 4:
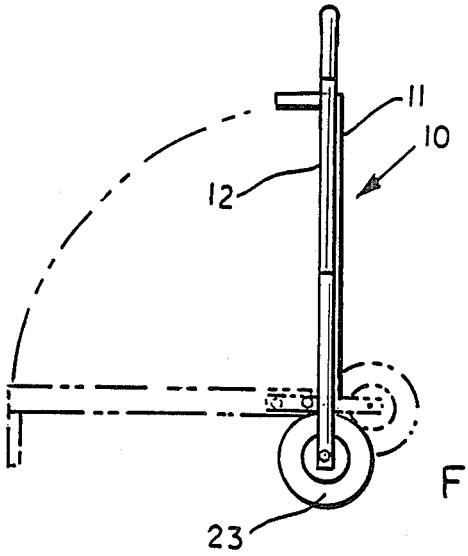
FIG. 4 is side view of the station shown with the platform folded.
Figure 5:
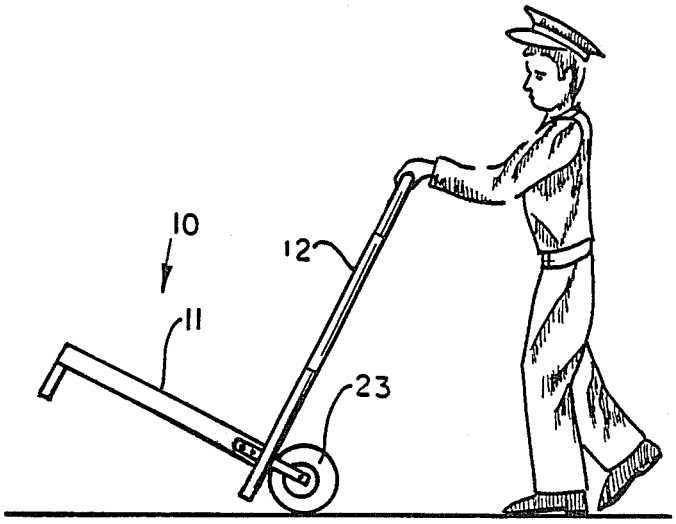
FIG. 5 is a side view showing the station being moved by a traffic control person.
Figure 6:
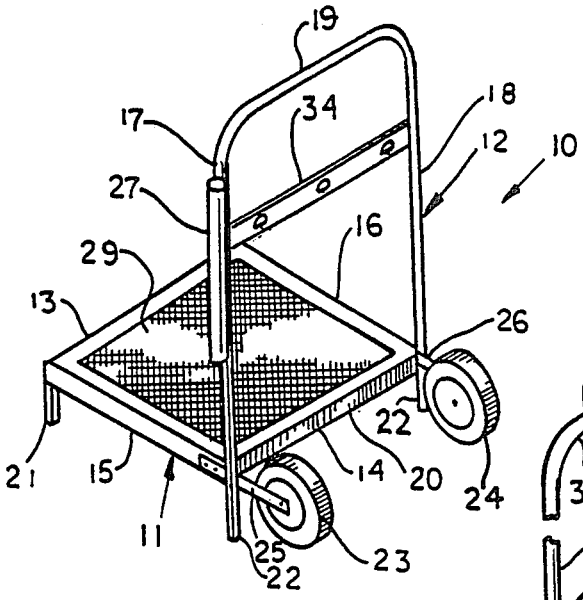
FIG. 6 is an isometric view of the station with no signs in place.

Now with more particular reference to the drawings, I show a portable illuminated signal person station 10 made up of a generally rectangular first frame 11 and a generally rectangular second frame 12. The first frame 11 has a first end 13, second end 14, a first side 15 and a second side 16. First frame 11 may be made of angle iron or other suitable material. The second frame 12 has a first side 17, second side 18, first end 19 and a second end 20. Second frame 12 may be made of a tubular, or other suitable material. The first frame 11 has spaced first legs 21 attached to the first end 13. Second legs 22 are attached to second frame 12. Second legs 22 extend outward a distance equal to the length of the first legs 21. The sides 17 and 18 of the second frame 12 are swingably attached to first frame 11 whereby the second frame 12 can be swung from a position perpendicular to the first frame 11, as shown in FIGS. 1 through 3 and 5 and 6, or to a position generally parallel to the first frame, as shown in FIG. 4. When in the folded position, the station 10 is suitable to be transported in a trunk of a police car or the like.

Spaced brackets 25 and 26 are fixed to the sides 15 and 16 of the first frame 11 and extend rearwardly and terminate in distal ends. Wheels 23 and 24 are rotatably supported on the distal ends of the brackets 25 and 26.

Figure 7:
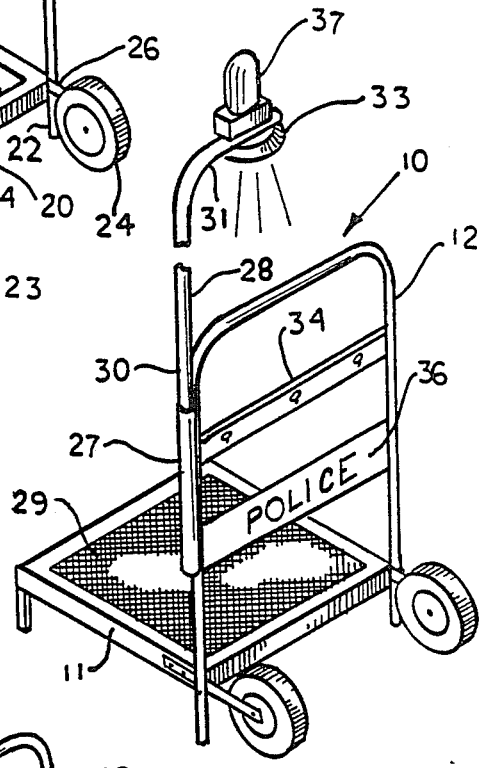
FIG. 7 is an isometric view of the station with a flashing light and a spotlight supported thereon.
Figure 8:
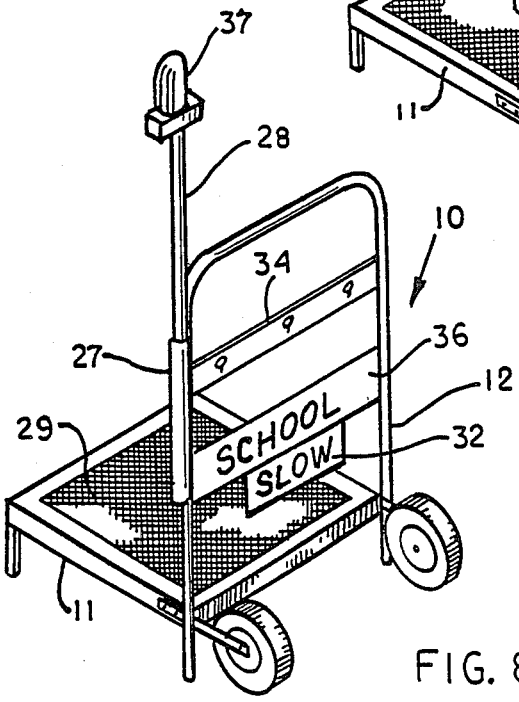
FIG. 8 is an isometric view of the portable illuminated traffic signal person station showing the use of a combination caution light and signs on the stand.

A tubular support 27 is fixed to the second frame 12. The tubular support 27 can receive an elongated support member, such as light support member 28, which has a light fixed to its upper end. Support member 28 has a main part 30 and an outwardly extending end 31 diposed generally at right angles to the main part 30. The light 37 may be a red flashing emergency light or it could be a combination of a red flashing light 37 and a spotlight 33 as shown in FIG. 7. The light support member 28 could be L-shaped as shown in FIG. 7 and the spotlight 33 fixed on the outwardly extending end 31.

A bar 34 could be fixed to the back of the second frame 12. Bar 34 could have reflectors 35 on it. Second reflector 41 could be supported on first frame 11. A stop sign 42 could be supported on light support member 28. Other suitable traffic signals could be supported on this light support member 28 or a similar rod.

A plate 36 is attached to second frame 12 at the lower part thereof and the plate 36 is adapted to support a sign 32.

Platform 29 is attached to the first frame 11 for a person to stand on to direct traffic. The platform 29, shown in FIG. 1, comprises expanded metal fixed to the first frame 11. A plain plate-like platform could be used, however.

The size, style and shapes of the portable illuminated signal person station could be changed with the desires of the designer from a metal fabrication as described above to having a platform molded into a one-piece unit of plastic, fiberglass, polypropoline or other suitable type material. The platform may be made of a convenient size, with or without wheels, to be stored in the trunk of a police officer's car or the like and at an accident site the signal person station will be readily available. Suitable supports can be provided on it for batteries or other power supply. Hand rails could be provided if desired and the station could incorporation a radio mount and other similar devices desired by the user.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A portable illuminated signal person station [10] comprising a generally rectangular or square first frame [11] and a generally rectangular second frame [12], said first frame [11] having a first end [13], a second end [14], a first side [15] and a second side [16], said second frame [12] having a first side [17], a second side [18], a first end [19] and a second end [20], said first frame [11] having spaced first legs [21] attached to said first end [13], said sides [17, 18] of said second frame [12] being swingably attached to said first frame [11] whereby said second frame [12] can swing from a position in a plane generally parallel to said first frame [11], said second frame [12] having second legs [22] fixed thereto and extending therefrom, spaced wheels [23,24], spaced brackets fixed to said sides of said first frame and extending rearwardly therefrom and terminating in distal ends, said wheels [23,24] being rotatably supported on said distal ends of said brackets [25,26], and a platform [29 ] fixed to said first frame [11] for a person to stand on to direct traffic.

2. The station recited in claim 1 wherein said first frame [11] is made of angle iron and said second frame [12] is made of a tubular material.

3. The station recited in claim 1 wherein a light is supported on a light support member [28].

4. The station recited in claim 2 wherein a tubular light support means [27] comprises a tubular member fixed to one said side [17,18 ] of said second frame [12].

5. The station recited in claim 4 wherein said light is supported on said light support member [28] inserted in said tubular light support member [27 ].

6. The station recited in claim 5 wherein said light support member [28]]is generally L-shaped.

7. The station recited in claim 6 wherein said L-shaped light support member [28] has a main part [30] and an outwardly extending end [31] disposed generally at right angles to said main part [30], said light is supported on said outwardly extending end [31].

8. The station recited in claim 5 wherein said light [37] is a caution type light.

9. The station recited in claim 8 wherein said platform [29] comprises expanded metal fixed to said first frame [11].

10. The station recited in claim 8 wherein said light includes a spotlight [33] adapted to be directed on a person standing on said platform [29].

11. The station recited in claim 10 wherein a bar [34] is fixed to said second frame [12] and reflectors [35] are supported adjacent said bar [34].

12. The station recited in claim 11 wherein a plate [36] is attached to said second frame [12] at the lower part thereof, said plate [36] being adapted to support a sign [32].

* * * * *